US008342184B2

(12) United States Patent
Inagaki et al.

(10) Patent No.: US 8,342,184 B2
(45) Date of Patent: Jan. 1, 2013

(54) NON-COMBUSTION FLAVOR INHALATION ARTICLE

(75) Inventors: Michihiro Inagaki, Yokohama (JP); Morio Yajima, Yokohama (JP); Manabu Yamada, Tokyo (JP); Hiroshi Sasaki, Tokyo (JP); Manabu Takeuchi, Tokyo (JP); Kota Takeda, Tokyo (JP)

(73) Assignee: Japan Tobacco Inc., Tokyo (JP)

( * ) Notice: Subject to any disclaimer, the term of this patent is extended or adjusted under 35 U.S.C. 154(b) by 0 days.

(21) Appl. No.: 13/091,920

(22) Filed: Apr. 21, 2011

(65) Prior Publication Data

US 2011/0192408 A1 Aug. 11, 2011

Related U.S. Application Data

(63) Continuation of application No. PCT/JP2009/068273, filed on Oct. 23, 2009.

(30) Foreign Application Priority Data

Oct. 23, 2008 (JP) ..... 2008-273506

(51) Int. Cl.
*A24F 47/00* (2006.01)

(52) U.S. Cl. ..... 131/271

(58) Field of Classification Search ..... None
See application file for complete search history.

(56) References Cited

U.S. PATENT DOCUMENTS

| | | | | |
|---|---|---|---|---|
| 4,938,236 | A | 7/1990 | Banerjee et al. | |
| 4,955,399 | A | 9/1990 | Potter et al. | |
| 5,692,525 | A * | 12/1997 | Counts et al. | 131/194 |
| 2003/0154991 | A1 | 8/2003 | Fournier et al. | |

FOREIGN PATENT DOCUMENTS

| | | | |
|---|---|---|---|
| JP | 2-190171 | A | 7/1990 |
| JP | 3-112477 | A | 5/1991 |
| JP | 11-503912 | A | 4/1999 |
| JP | 11-178562 | A | 7/1999 |
| JP | 3431632 | B2 | 7/2003 |
| JP | 3588469 | B2 | 11/2004 |
| JP | 3645921 | B2 | 5/2005 |
| JP | 2005-517421 | A | 6/2005 |
| WO | WO 95/27411 | A1 | 10/1995 |
| WO | WO 95/27412 | A1 | 10/1995 |
| WO | WO 96/32854 | A1 | 10/1996 |
| WO | WO 2007/042941 | A2 | 4/2007 |

OTHER PUBLICATIONS

English machine translation of JP 3431632 B2.*
English machine translation of JP 11-178562 A.*

* cited by examiner

*Primary Examiner* — Michael J Felton
(74) *Attorney, Agent, or Firm* — Birch, Stewart, Kolasch & Birch, LLP

(57) ABSTRACT

A non-combustion flavor inhalation article includes a heating device including a heater to be heated to a temperature between 80 and 140° C., and a roll including a tobacco sheet to be disposed in contact with the heater.

9 Claims, 6 Drawing Sheets

NON-COMBUSTION FLAVOR INHALATION ARTICLE

CROSS REFERENCE TO RELATED APPLICATIONS

This is a Continuation Application of PCT Application No. PCT/JP2009/068273, filed Oct. 23, 2009, which was published under PCT Article 21(2) in Japanese.

This application is based upon and claims the benefit of priority from prior Japanese Patent Application No. 2008-273506, filed Oct. 23, 2008, the entire contents of which are incorporated herein by reference.

BACKGROUND OF THE INVENTION

1. Field of the Invention

The present invention relates to a non-combustion flavor inhalation article used to inhale effective components of tobacco leaves such as nicotine and flavor in a vapor state.

2. Description of the Related Art

Conventional cigarettes generate smoke and components such as tar with combustion.

On the other hand, flavor inhalation articles are known which are used to inhale vapor components including nicotine by heating tobacco without combusting the tobacco (see, for example, Jpn. Pat. Appln. KOKAI Publication No. 2-190171, Jpn. Pat. Appln. KOKAI Publication No. 3-112477, Japanese Patent No. 3645921, and International Publication No. WO 2007/042941).

However, those of Jpn. Pat. Appln. KOKAI Publication No. 2-190171 and Jpn. Pat. Appln. KOKAI Publication No. 3-112477 utilize heat of chemical reaction and are therefore poor in temperature controllability. That of Japanese Patent No. 3645921 heats a cigarette by using, for example, eight heating segments and is therefore poor in heating efficiency. That of International Publication No. WO 2007/042941 heats tobacco to a temperature between 150 and 220° C. and thus highly possibly involves smoke generation.

BRIEF SUMMARY OF THE INVENTION

An object of the present invention is to provide a non-combustion flavor inhalation article which enables enjoyment of flavor without generating smoke and combustion products.

According to an aspect of the present invention, there is provided a non-combustion flavor inhalation article comprising: a heating device comprising a heater to be heated to a temperature between 80 and 140° C.; and a roll including a tobacco sheet to be disposed in contact with the heater.

In the present invention, the heater has a hollow cylindrical structure, the roll has a hollow cylindrical structure including only a tobacco sheet or a tobacco sheet and a wrapping material wrapping the outside of the sheet, the roll is inserted into the hollow part of the heater, and the tobacco sheet or the wrapping material wrapping the outside of the sheet is in contact with the inside surface of the heater. The wrapping material is preferably made of a heat conductive material, for example, a metal foil. The heat conductive material is preferably the same material as that of the inside surface of the heater.

In the non-combustion flavor inhalation article according to the present invention, the roll including the tobacco sheet is heated in contact with the heater and therefore, the tobacco sheet can be uniformly heated in a well controlled manner in a short time. Then, the heating temperature of the roll including the tobacco sheet with the heater ranges between 80 and 140° C., which is lower than the temperature at which smoke is generated from tobacco leaves, and thus, smoke and combustion products are not generated. Therefore, the non-combustion flavor inhalation article according to the present invention enables enjoyment of flavor without giving any care of annoyance to neighbors. Also, because ash and burnt deposits which are observed in usual cigarettes are not generated, the roll after used can be easily recovered and discarded.

DETAILED DESCRIPTION OF THE INVENTION

Embodiments of the present invention will be described with reference to the drawings.

Figure 1:
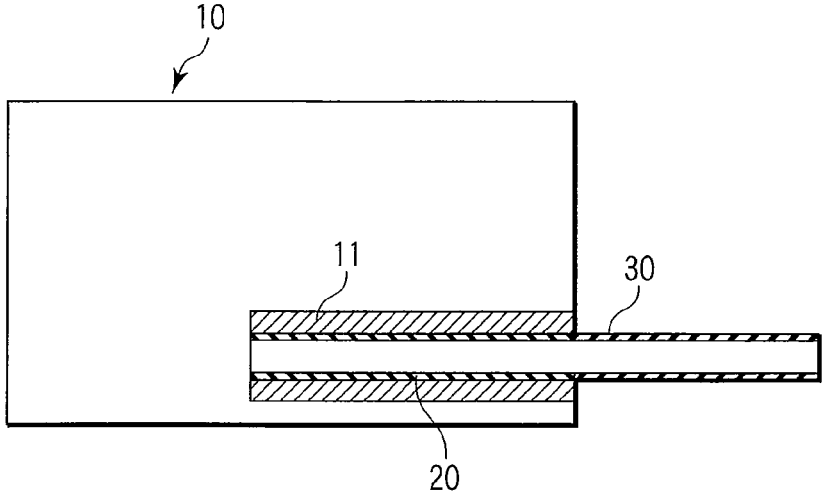
FIG. 1 is a cross-sectional view of a non-combustion flavor inhalation article according to an embodiment of the present invention.

FIG. 1 is a cross-sectional view of a non-combustion flavor inhalation article according to an embodiment of the present invention. As shown in FIG. 1, a heating device 10 is provided with a heater 11 having a hollow cylindrical structure. The heater 11 is heated to a temperature between 80 to 140° C. A roll 20 including a tobacco sheet shaped into a hollow cylindrical structure is inserted into the hollow part of the heater 11. The roll 20 has a hollow cylindrical structure including only a tobacco sheet or a tobacco sheet and a wrapping material wrapping the outside of the tobacco sheet, and is disposed such that the tobacco sheet or the wrapping material wrapping the outside of the tobacco sheet is made in contact with the inside surface of the heater 11. A mouthpiece 30 is attached to one end of the roll 20. No filter is disposed at the suction port of the mouthpiece 30. The size, shape and material of the mouthpiece are appropriately selected so as to make it easy to hold the mouthpiece 30 in mouth.

The tobacco sheet is manufactured by a known method (see, for example, Jpn. PCT National Publication No. 2004-510422). An example of a method of producing a tobacco sheet will be described. Dried raw materials of tobacco leaves are roughly broken, water is added thereto, and then it is stirred, which is separated into water-extract and insoluble tobacco residue. The water-extract is dried under reduced pressure to concentrate. Pulp is added to the insoluble tobacco residue and fiberized with a refiner, which is then made into a paper sheet. The concentrated solution of the water-extract is added to the paper sheet, which is then dried to produce a tobacco sheet.

Figure 2:
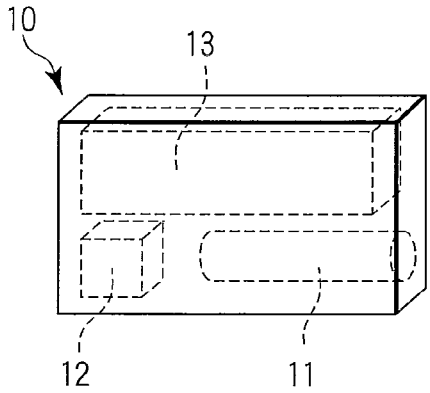
FIG. 2 is a perspective view showing a heating device.

FIG. 2 shows a perspective view of a heating device 10. As described above, the heating device 10 is provided with the heater 11 having a hollow cylindrical structure. A control circuit 12, a temperature sensor (not shown) and a battery 13 are housed in the heating device 10. Examples of the temperature sensor include a thermocouple and a thermistor. The control circuit 12 is operated by the battery 13 to feedback control the temperature of the heater detected by the temperature sensor between 80 and 140° C.

Figure 3:
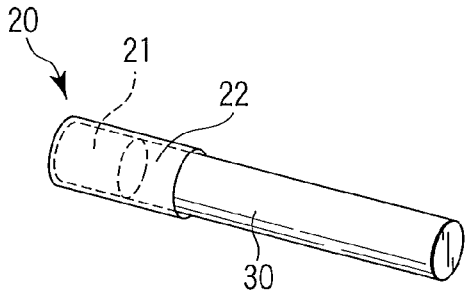
FIG. 3 is a perspective view showing an example of a roll including a tobacco sheet.

FIG. 3 is a perspective view of an example of the roll 20 including a tobacco sheet. The roll 20 is obtained by wrapping the outside of the tobacco sheet 21 shaped into a hollow cylindrical shape with a heat conductive wrapping material 22. The length of the wrapping material 22 is larger than that of the tobacco sheet 21. A mouthpiece 30 is attached to one end of the shaped wrapping material 22 so as to be wrapped around the tobacco sheet 21.

As shown in FIG. 3, it is preferable to wrap the outside of the tobacco sheet 21 from the viewpoint of achieving uniformity in thermal conductivity and preventing adhesion of stains. As the heat-conductive wrapping material 22, an aluminum foil or aluminum-laminated paper is typically used.

A composite material obtained by laminating the tobacco sheet 21 and the heat-conductive wrapping material 22 in advance may be produced in the following manner. For example, a wound roll of tobacco sheet and a wound roll of wrapping material are drawn out simultaneously. An adhesive material is sprayed on the bonding surface of the both or transferred to the bonding surface through a transfer roller to expand the both while applying pressure, and then, the bonded product is subjected to a step of drying the adhesive material to produce a composite material. The adhesive material may be sprayed on or applied to the wrapping material side. As the adhesive material, polysaccharides for food and the like may be used.

The above composite material may also be produced by another method. The broken tobacco, adhesive material and water (and a flavor and a humectant such as glycerin, as required) are mixed in a necessary ratio in advance to prepare slurry. Then, the slurry is cast in a necessary thickness on the wrapping material running along the line. Then, the above slurry is dried to make a composite material comprising the above wrapping material and film-like tobacco layer which are bonded with each other.

The roll 20 preferably has a proper shape stability and elasticity so as to be uniformly heated in close contact with the inside surface of the heater 11. The following method may be adopted to design these characteristics appropriately. For example, the tobacco sheet 21 may be wound as a single or multiple layers. In this case, only the tobacco sheet 21 may be spirally wound or a laminate of the tobacco sheet 21 and aluminum foil may be spirally wound. Also, a support provided with a plurality of projections may be disposed inside the roll 20 to support the inside surface of the tobacco sheet 21 with channels formed between the projections and with the inside surface of the tobacco sheet 21 exposed to the channels. Also, a support may be disposed inside of the roll, which support has a hollow cylindrical structure and having an opening (slit) in a part thereof formed to allow the inside surface of the tobacco sheet 21 to be exposed.

Figure 4:
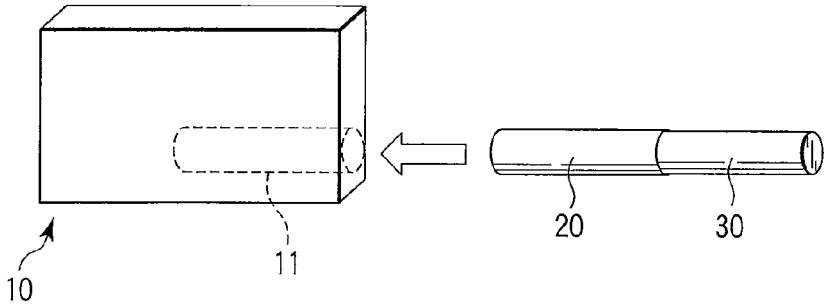
FIG. 4 is an explanatory view showing a state of inserting the roll including a tobacco sheet into a heater of a heating device.

As shown in FIG. 4, the roll 20 including a tobacco sheet is inserted into the heater 11 having a hollow cylindrical structure of the heating device 10 to constitute a non-combustion flavor inhalation article shown in FIG. 1.

The heater 11 preferably has such a structure that a hollow cylinder made of the same material as the wrapping material 22 (for example, aluminum) of the roll 20 is coated with an electric resistor. This is because if the material of the inside of the heater 11 is different from the material of the wrapping material 22, electric erosion is undesirably generated.

At least one of the roll 20 and the heating device 10 may contain a flavor or a flavor carrier. It is preferable to make the flavor carried by a carrier so that the flavor is released by heating from the viewpoint of storage stability.

After the roll 20 is filled in the heater 11, the heater 11 is heated to a predetermined temperature (80 to 140° C.) in about 10 seconds under control with the control circuit 12. When a user sucks from the mouthpiece 30 in the same manner as in a usual cigarette, effective components originated from tobacco leaves and flavor components producing smoking taste can be taken as vapor. At this time, smoke and combustion products are not generated from the tobacco sheet 21. Thus, the user can enjoy the flavor without any care of annoyance to neighbors. Also, because ash and burnt deposits which are observed in usual cigarettes are not generated, the roll after used can be easily recovered and discarded.

EXAMPLES

Examples of the present invention will be described.

Example 1

In this example, preferable heating temperature of a heater was investigated.

As shown in FIG. 3, a roll 20 is produced by attaching a mouthpiece 30 made of a paper tube to one end of a tobacco sheet 21 shaped into a hollow cylindrical shape by applying glue to the lapping part of the sheet and wrapping the entire periphery of the tobacco sheet 21 and the mouthpiece 30 with a wrapping material 22 made of an aluminum foil to which a glue is applied entirely. The tobacco sheet 21 was obtained by shaping a sheet having a length of 10 mm and a width of 27 mm into a cylinder having a diameter of about 8 mm. The mouthpiece 30 has a diameter of about 8 mm and a length of 48 mm. The wrapping material 22 was obtained by winding an aluminum foil having a length of 20 mm and a width of 27 mm. The roll 20 was inserted into a heater 11 of the heating device 10 to provide a non-combustion flavor inhalation article.

The temperature of the heater 11 was changed in a range from 60° C. to 150° C. to examine smoke generation, nicotine delivery and impact.

The smoke generation was evaluated by observing the amount of smoke rising from the roll during heating for 10 seconds by naked eye. The nicotine delivery shows the amount of nicotine flowing out of the mouthpiece when the flavor inhalation article was sucked by a volume of 35 mL for 2 seconds when 10 seconds passed since the heating started. The impact was evaluated by smoking test monitors. The test results are shown in Table 1.

The smoke generation was slightly observed at a heater temperature of 140° C. and the smoke generation is clearly observed at a heater temperature of 150° C. by naked eye. It was confirmed that the impact was sensuously perceptible at a temperature of 80° C. or more.

TABLE 1

| Heater temperature (° C.) | Smoke generation | Nicotine delivery (μg) | Impact |
|---|---|---|---|
| 60 | No | 0.07 | Difficult to perceive |
| 80 | No | 0.15 | Slightly perceptible |
| 100 | No | 0.48 | Weak |
| 120 | No | 1.35 | Slightly weak |
| 130 | No | 2.32 | Adequate |
| 140 | Slightly generated | 3.50 | Adequate |
| 150 | Generated | 5.65 | Slightly strong |

Next, the temperature of the heater 11 was changed, and components flowed out of the roll were collected when the non-combustion flavor inhalation article was sucked by a Tenax tube and then the collected components were qualitatively analyzed by GC/MS. The results of analysis when the heater temperature was set to 125° C. or 150° C. are shown in FIGS. 5(*a*) and (*b*).

Figure 5:
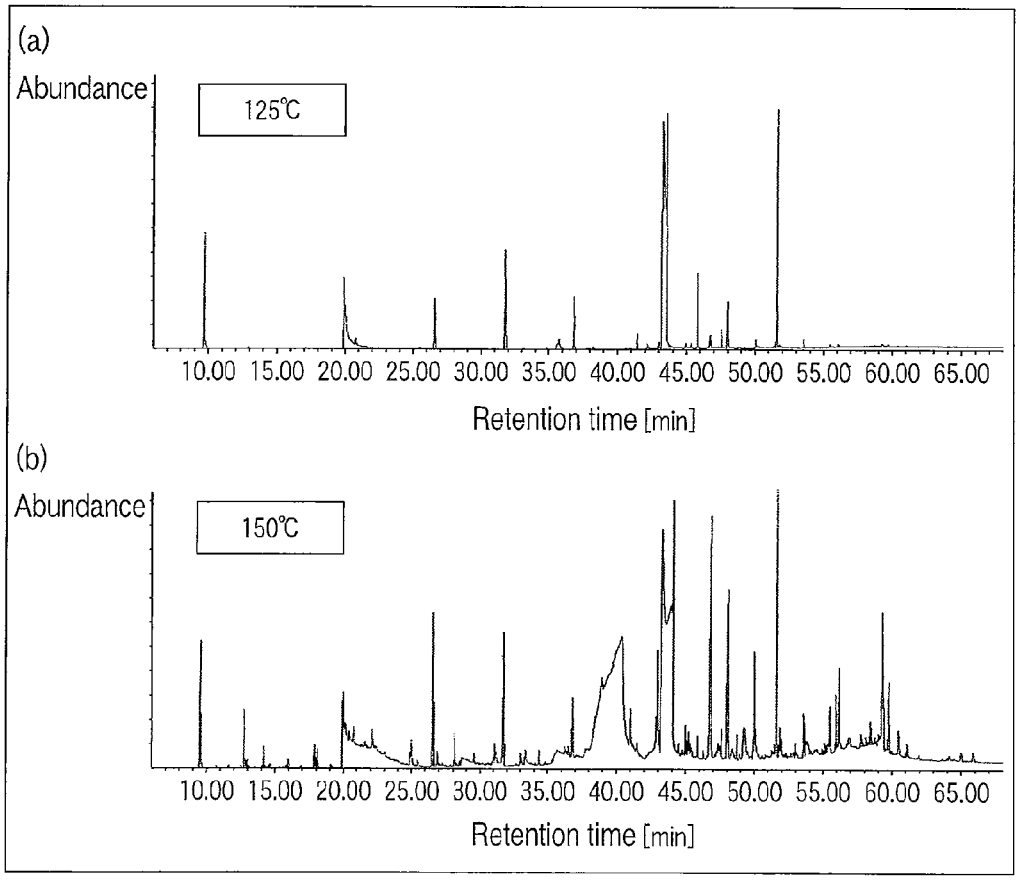
FIG. 5 is a view showing the results obtained by carrying out GC/MS qualitative analysis of components flowed out of a roll when the non-combustion flavor inhalation article is sucked the temperature of a heater is set to 125° C. or 150° C.

In the case where the heater temperature was 125° C. shown in FIG. 5(*a*), only the effective components derived from tobacco leaves were detected. The results of the qualitative analysis when the heater temperature was 125° C. or less, though not shown, were similar to that of FIG. 5(*a*). On the other hand, in the case where the heater temperature was 150° C. shown in FIG. 5(*b*), thermally decomposed products such as benzene were detected.

From the results of Table 1 and FIG. 5, it is found that the heating temperature at which the tobacco sheet is heated with the heater is preferably between 80 and 140° C. and more preferably between 100 and 130° C.

Example 2

Figure 6:
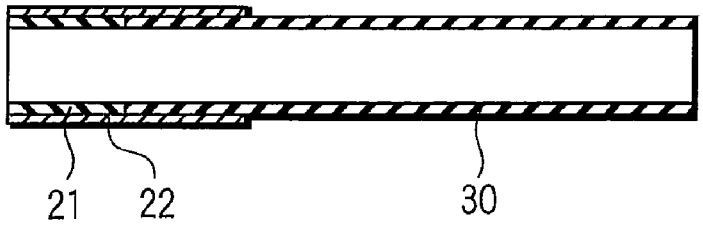
FIG. 6 is a cross-sectional view of a roll including a tobacco sheet in Example 2.

In this example, the number of turns of the roll was changed in the following manner to produce a roll as shown in FIG. 6 to which a mouthpiece was attached.

Example 2A

A tobacco sheet 21 having a length of 20 mm and a width of 18 mm and an aluminum foil having a length of 20 mm and a width of 18 mm were laminated and were wound singly to produce a cylinder having a diameter of about 5 mm and a length of 20 mm.

Example 2B

A tobacco sheet having a width of 36 mm and a length of 20 mm and an aluminum foil having a width of 36 mm and a length of 20 mm were laminated and were spirally wound two-fold to produce a cylinder having a diameter of about 5 mm and a length of 20 mm.

A mouthpiece 30 having a diameter of about 5 mm and a length of 25 mm was attached to one end of each of the above cylinders of Examples 2A and 2B and a wrapping material 22 made of a separate aluminum foil having a length of 30 mm and a width of 18 mm was wound around the peripheries of the mouthpiece and cylinder to cover them. Each roll 20 was inserted into a heater of a heating device to obtain a non-combustion flavor inhalation article. The temperature of the heater was set to 115° C. to examine the nicotine delivery when the flavor inhalation article was sucked by a volume of 35 mL from the mouthpiece for 2 seconds.

Figure 7:
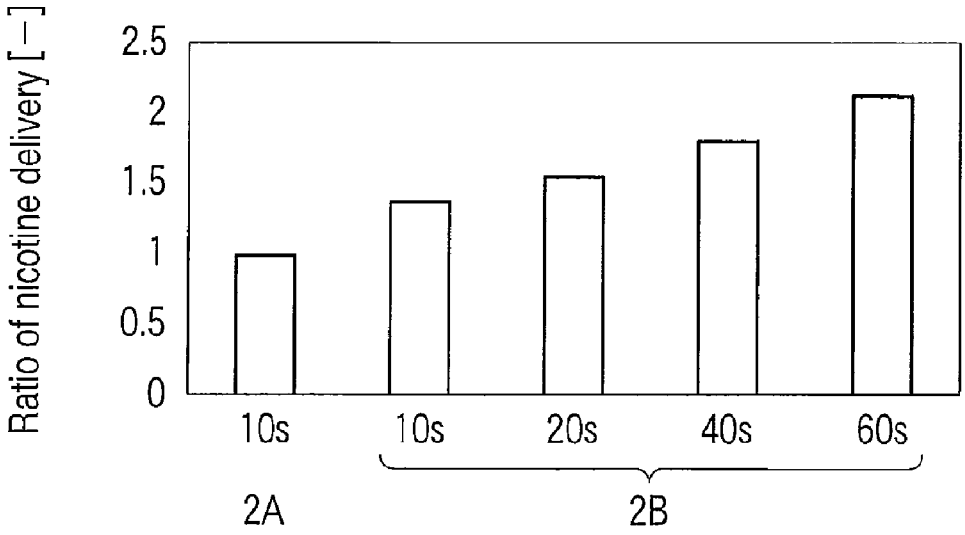
FIG. 7 is a view showing nicotine delivery of non-combustion flavor inhalation articles in Example 2.

The nicotine delivery from the non-combustion flavor inhalation article obtained in each of Examples 2A and 2B is shown in FIG. 7. FIG. 7 shows the nicotine delivery 10 seconds after the roll is inserted in the case of Example 2A and the nicotine delivery 10 to 60 seconds after the roll is inserted in the case of Example 2B. The nicotine delivery is normalized by defining the value of Example 2A as unity and the normalized values are shown in FIG. 7.

As shown in FIG. 7 (10 s), the nicotine delivery in Example 2B in which a tobacco sheet and an aluminum foil were laminated and spirally wound two-fold is increased compared with the nicotine delivery in Example 2A which was wound singly. The reason for this is considered to be that the effective area of the tobacco sheet is increased in Example 2B.

Also, in Example 2B, the nicotine delivery is increased with the increase in elapsed time (from 10 seconds to 60 seconds). The reason for this is considered to be that heat is conducted to the inside of the roll with the increase in elapsed time. Therefore, such advantages are obtained that the flavor can be controlled and duration of use (number of puffs) can be increased when a user controls the heating time.

Example 3

In this example, the effect obtained by disposing a support provided with a plurality of projections to support an inside surface of the tobacco sheet with channels formed between the projections and with the inside surface of the tobacco sheet exposed to the channels. This structure is called a channel ventilation (CV) structure.

Figure 8:
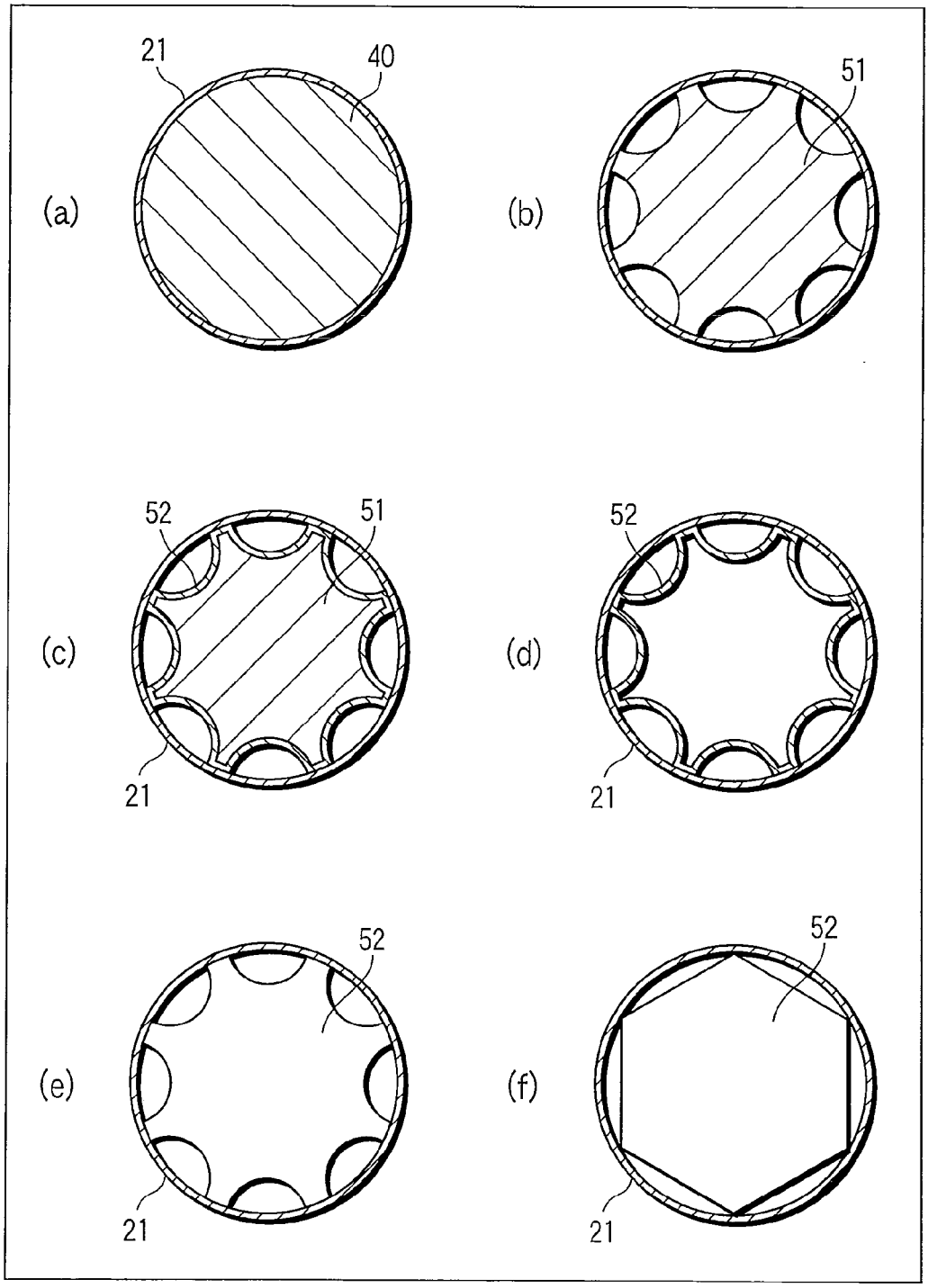
FIG. 8 is a cross-sectional view of a roll including a tobacco sheet with a support disposed therein in Example 3.

FIG. 8(*a*) shows a cross-sectional view of the tobacco sheet 21 (Comparative Example 3) with the hollow part packed with an acetate filter, and FIG. 8 (*b*) to (*f*) show cross-sectional views of the tobacco sheets 21 (Examples 3B to 3F) having a CV structure formed by disposing a support in the hollow part.

Example 3A

A tobacco sheet having a length of 10 mm and a width of 27 mm was wound singly to produce a cylinder having a diameter of about 8 mm and a length of 10 mm. A mouthpiece having a diameter of about 8 mm and a length of 48 mm was attached to one end of the cylinder. A wrapping material made of an aluminum foil having a length of 20 mm and a width of 27 mm was wound around the peripheries of the cylinder and mouthpiece to cover them.

Comparative Example 3

As shown in FIG. 8(*a*), a tobacco sheet 21 having a length of 10 mm and a width of 27 mm was wound singly around a columnar acetate filter 40 having a diameter of about 8 mm and a length of 10 mm. A mouthpiece having a diameter of about 8 mm and a length of 48 mm was attached to one end of the tobacco sheet 21. A wrapping material made of an aluminum foil having a length of 20 mm and a width of 27 mm was wound around these members to cover them.

Example 3B

As shown in FIG. 8(*b*), a tobacco sheet 21 having a length of 10 mm and a width of 27 mm was singly wound around a support 51 which was made of Teflon (registered trademark) having a diameter of about 8 mm and a length of 20 mm and was provided with a plurality of projections between which concave parts were formed. As a result, channels through which effective components flowing from the tobacco sheet 21 were formed between two projections adjacent to each other and the tobacco sheet 21. A mouthpiece having a diameter of about 8 mm and a length of 48 mm was attached to one end of the tobacco sheet 21. A wrapping material made of an aluminum foil having a length of 20 mm and a width of 27 mm was wound around these members to cover them.

Example 3C

As shown in FIG. 8(*c*), a support 51 was prepared which was made of Teflon (registered trademark) having a diameter of about 8 mm and a length of 20 mm and was provided with a plurality of projections between which concave parts were formed and the side surface of the support 51 was covered with an aluminum foil 52. A tobacco sheet 21 having a length of 10 mm and a width of 27 mm was wound singly around the support 51. A mouthpiece having a diameter of about 8 mm and a length of 48 mm was attached to one end of the tobacco sheet 21. A wrapping material made of an aluminum foil having a length of 20 mm and a width of 27 mm was wound around these members to cover them.

Example 3D

As shown in FIG. 8(*d*), a support was prepared which was made of Teflon (registered trademark) having a diameter of about 8 mm and a length of 20 mm and was provided with a plurality of projections between which concave parts were formed and the side surface of the support was covered with an aluminum foil 52. A tobacco sheet 21 having a length of 10 mm and a width of 27 mm was wound singly around the support. Then, the support was pulled out from the tobacco sheet 21 so as to leave only the aluminum foil 52 (hereinafter referred to as aluminum open end). The inside of the aluminum foil 52 forms a hollow structure. The aluminum foil 52 functions as a support in a state that the Teflon (registered trademark) support is pulled out. A mouthpiece having a diameter of about 8 mm and a length of 48 mm was attached to one end of the tobacco sheet 21. A wrapping material made of an aluminum foil having a length of 20 mm and a width of 27 mm was wound around these members to cover them.

Example 3E

As shown in FIG. 8(*e*), a support was prepared which was made of Teflon (registered trademark) having a diameter of about 8 mm and a length of 20 mm and was provided with a plurality of projections between which concave parts were formed and the side surface of the support was covered with an aluminum foil 52. A tobacco sheet 21 having a length of 10 mm and a width of 27 mm was wound singly around the support 21. Then, the support was pulled out from the tobacco sheet 21 so as to leave only the aluminum foil 52 and also, the open surface at one end was closed by the aluminum foil 52 (hereinafter referred to as aluminum close end). Specifically, the following process was carried out. The aluminum foil 52 applied to the side surface of the support was made to be longer than the length of the support so as to leave a surplus part projecting from the end of the support. After the tobacco sheet 21 was wound, the support was pulled out while inwardly folding the surplus part of the aluminum foil 52 and the one open end was closed by the aluminum foil 52. Accordingly, though the inside of the aluminum foil 52 has a hollow structure, one end of the hollow structure is closed. This aluminum foil 52 functions as a support in the state that the Teflon (registered trademark) support is pulled out. It is not shown in FIG. 8(*e*) that the aluminum foil 52 at the end surface is folded. A mouthpiece having a diameter of about 8 mm and a length of 48 mm was attached to one end of the tobacco sheet 21. A wrapping material made of an aluminum foil having a length of 20 mm and a width of 27 mm was wound around these members to cover them.

Example 3F

As shown in FIG. 8(*f*), a commercially available heat-shrinkable tube (PFE, wall thickness: 0.2 mm) was covered on a hexagon wrench having a diameter of about 8 mm and hot air was blown on the tube with a heat gun to make the tube shrunk, thereby shaping the tube into a hexagonal shape. The shaped heat-shrinkable tube from which the hexagon wrench was pulled out was then cut into a length of 20 mm. The side surface and end surfaces of the tube were covered with an aluminum foil 52 to obtain a support. A tobacco sheet 21 having a length of 10 mm and a width of 27 mm was wound singly around the support. A mouthpiece having a diameter of about 8 mm and a length of 48 mm was attached to one end of the tobacco sheet 21. A wrapping material made of an aluminum foil having a length of 20 mm and a width of 27 mm was wound around these members to cover them.

Each roll was inserted into a heater of a heating device to obtain a non-combustion flavor inhalation article. The temperature of the heater was set to 125° C. to examine the nicotine delivery when the flavor inhalation article was sucked by a volume of 35 mL for 2 seconds from the mouthpiece.

Figure 9:
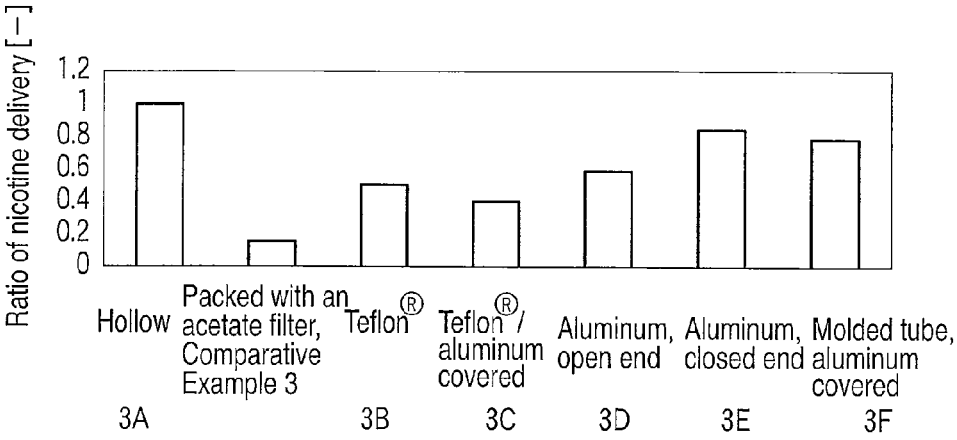
FIG. 9 is a view showing nicotine delivery of non-combustion flavor inhalation articles in Example 3.

The nicotine delivery from the non-combustion flavor inhalation article obtained in each of Example 3A, Comparative Example 3 and Examples 3B to 3F is shown in FIG. 9. The nicotine delivery is normalized by defining the value of Example 3A as unity to indicate and the normalized values are shown in FIG. 9.

As shown in FIG. 9, Comparative Example 3 in which an acetate filter is packed is undesirable because the loss of the nicotine delivery is high. In Examples 3B to 3F in which a support is disposed inside of a tobacco sheet to form a channel structure, on the other hand, the loss of nicotine delivery is not so increased. In other words, a sufficient nicotine delivery is obtained by channel ventilation. In particular, the nicotine delivery is high in Examples 3E and 3F, which shows that it is effective to use a support having a channel structure with a thin wall and a small heat capacity. The nicotine delivery in each of the Examples is a slightly smaller than that in Example 3A having a hollow cylindrical structure. However, it is desirable to use a support having elasticity and rigidity in consideration of strength of the roll to stand mechanical production, deformation when the roll is packed in the device and close contact to the heater.

Example 4

In this example, the effect obtained by disposing a support inside of the roll was examined, the support having a hollow cylindrical structure and having an opening (slit) in a part thereof formed to allow the inside surface of the tobacco sheet to be exposed.

Example 4A

A tobacco sheet having a length of 20 mm and a width of 27 mm was wound singly to produce a cylinder having a diameter of about 8 mm and a length of 20 mm. A mouthpiece having a diameter of about 8 mm and a length of 25 mm was attached to one end of the cylinder. A wrapping material made of an aluminum foil having a length of 20 mm and a width of 27 mm was wound around these members to cover them.

Example 4B

Figure 10:
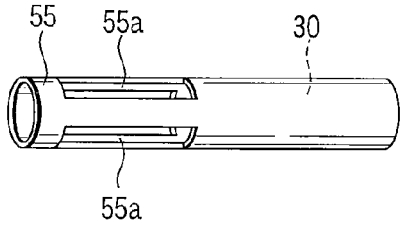
FIG. 10 is a perspective view showing a support in Example 4.

As shown in FIG. 10, a paper tube having a diameter of about 8 mm and a length of 48 mm was prepared as a support 55 and also as a mouthpiece and a slit 55*a* having a width of 3 mm and a length of 20 mm was cut out from the paper tube with a cutter so as to leave one end part 3 mm in length. Four slits 55*a* were formed on the outer periphery of the tube at intervals of about 3 mm. The length of the paper tube on the downstream side of the slit was 25 mm. A tobacco sheet having a length of 20 mm and a width of 27 mm was wound around the outside periphery of the slits and the lapping part of the sheet was bonded with glue. The outer periphery of the sheet was covered with a wrapping material made of an aluminum foil having a length of 30 mm and a width of 27 mm to which glue was applied entirely.

Each roll was inserted into a heater of a heating device to obtain a non-combustion flavor inhalation article. The temperature of the heater was set to 115° C. to examine the nicotine delivery when the flavor inhalation article was sucked by a volume of 35 mL for 2 seconds from the mouthpiece.

Figure 11:
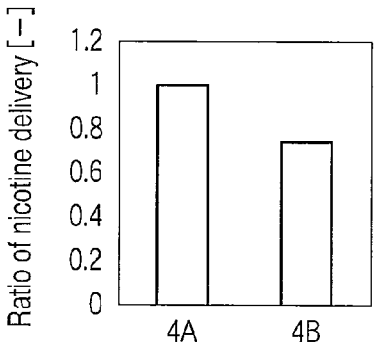
FIG. 11 is a view showing nicotine delivery of non-combustion flavor inhalation articles in Example 4.

The nicotine delivery from the non-combustion flavor inhalation article obtained in each of Examples 4A and 4B is shown in FIG. 11. The nicotine delivery is normalized by defining the value of Example 4A as unity and the normalized values are shown in FIG. 11.

As shown in FIG. 11, in the case of supporting the inside surface of the roll by the support 55 with slits as in Example 4B, the nicotine delivery is higher than that of Comparative Example 3 shown in FIG. 9, which shows that the loss of nicotine delivery is not so increased. With regard to this structure, it has a small heat capacity and is superior in the elasticity and rigidity of the roll, and it is desirable to make use of these supports in consideration of strength of the roll to stand mechanical production, deformation when the roll is packed in the device and close contact to the heater.

Example 5

In this example, the number of tobacco sheets, the length of the tobacco sheet, the length of the mouthpiece, and control pattern for the heater were changed to examine the effect in each of these factors.

Example 5A

One tobacco sheet having a diameter of about 8 mm and a length of 10 mm and a mouthpiece having a length of 48 mm were combined with each other, and a wrapping material made of an aluminum foil having the same width as that of the tobacco sheet and a length equal to that of the tobacco sheet plus 10 mm was wound around these members to cover them.

Example 5B

A two-ply tobacco sheet having a diameter of about 8 mm and a length of 10 mm and a mouthpiece having a length of 48 mm were combined with each other, and a wrapping material made of an aluminum foil having the same width as that of the tobacco sheet and a length equal to that of the tobacco sheet plus 10 mm was wound around these members to cover them.

Example 5C

A three-ply tobacco sheet having a diameter of about 8 mm and a length of 10 mm and a mouthpiece having a length of 48 mm were combined with each other, and a wrapping material made of an aluminum foil having the same width as that of the tobacco sheet and a length equal to that of the tobacco sheet plus 10 mm was wound around these members to cover them.

Example 5D

One tobacco sheet having a diameter of about 8 mm and a length of 20 mm and a mouthpiece having a length of 48 mm were combined with each other, and a wrapping material made of an aluminum foil having the same width as that of the tobacco sheet and a length equal to that of the tobacco sheet plus 10 mm was wound around these members to cover them.

Example 5E

One tobacco sheet having a diameter of about 8 mm and a length of 10 mm and a mouthpiece having a length of 25 mm were combined with each other, and a wrapping material made of an aluminum foil having the same width as that of the tobacco sheet and a length equal to that of the tobacco sheet plus 10 mm was wound around these members to cover them.

Example 5F

One tobacco sheet having a diameter of about 8 mm and a length of 10 mm and a mouthpiece having a length of 25 mm were combined with each other, and a wrapping material made of an aluminum foil having the same width as that of the tobacco sheet and a length equal to that of the tobacco sheet plus 10 mm was wound around these members to cover them. Then, the heater temperature was raised from 115° C. to 120° C. during inhaling with the flavor inhalation article.

Examples 5B and 5C each intend to increase the weight of the tobacco sheet by laminating tobacco sheets. Example 5D intends to increase the area of the tobacco sheet by increasing the length of the tobacco sheet. Example 5E intends to limit adsorption by the paper tube by reducing the length of the mouthpiece made of the paper tube. Example 5F intends to limit adsorption by the paper tube by reducing the length of the mouthpiece made of the paper tube and also to limit temperature drop caused by inflow of air by raising the temperature during inhaling with the flavor inhalation article. Each roll was inserted into a heater of a heating device to obtain a non-combustion flavor inhalation article. The temperature of the heater was set to 115° C. to examine the nicotine delivery when the flavor inhalation article was sucked by a volume of 35 mL for 2 seconds from the mouthpiece.

Figure 12:
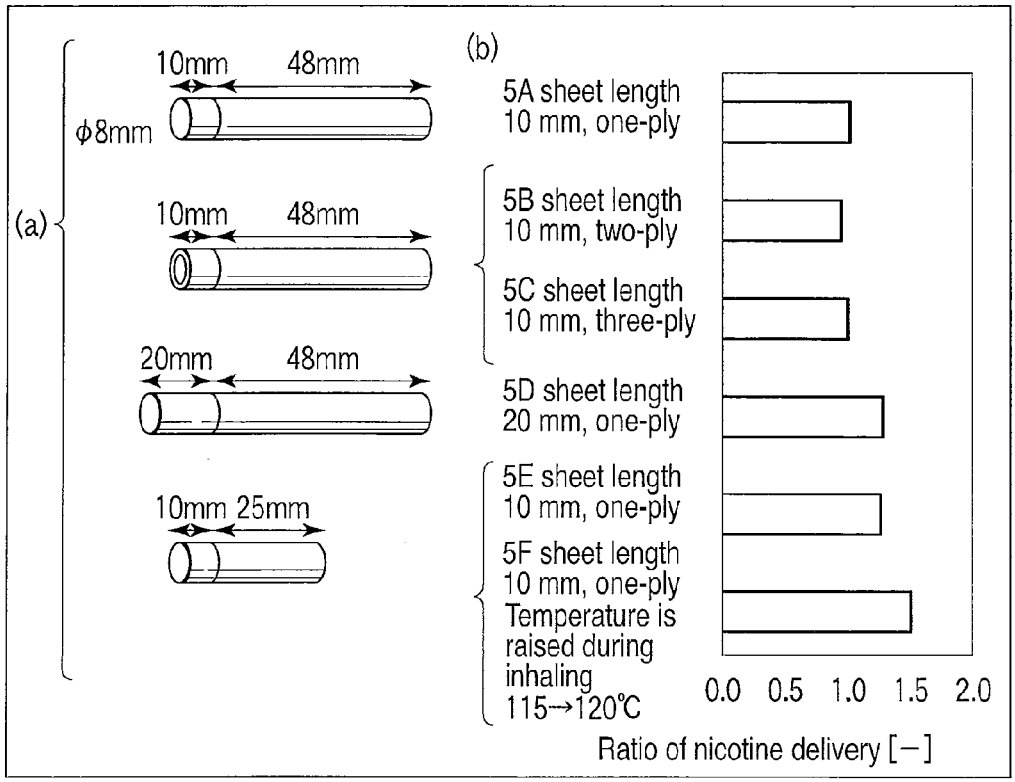
FIG. 12 is a perspective view showing combinations of a tobacco sheet and a mouthpiece in Example 5, and a view showing nicotine delivery of non-combustion flavor inhalation articles of Examples 5A to 5F.

FIG. 12(*a*) is a perspective view showing four types of combinations of a tobacco sheet and mouthpiece. FIG. 12(*b*) shows the nicotine delivery from each non-combustion flavor inhalation article obtained in Examples 5A to 5F. The nicotine delivery is normalized by defining the value of Example 5A as unity and the normalized values are shown in FIG. 12(*b*).

A sufficient nicotine delivery is obtained in any of Examples 5A to 5F. In particular, when adsorption by the paper tube is limited by reducing the length of the mouthpiece made of the paper tube and also to limit temperature drop caused by inflow of air by raising the temperature during inhaling with the flavor inhalation article as in Example 5F, the nicotine delivery is significantly increased.

Example 6

Figure 13:
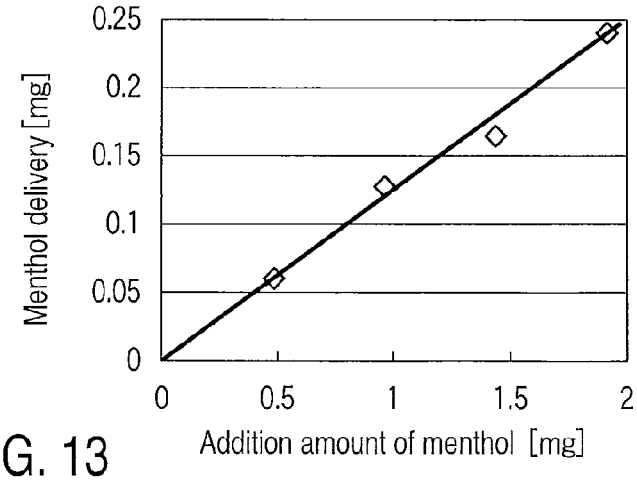
FIG. 13 is a view showing the menthol delivery of non-combustion flavor inhalation articles in Example 6.

In this example, menthol was added as a flavor to a tobacco sheet to produce a non-combustion flavor inhalation article. FIG. 13 shows the relationship between the addition amount of menthol to the tobacco sheet and the menthol delivery. As shown in FIG. 13, the menthol delivery is proportional to the addition amount of menthol to the tobacco sheet and, therefore, the menthol delivery can easily be controlled.

[Wrapping Material]

In the present invention, the heat of the heater can be conducted to the tobacco sheet uniformly and efficiently if the outside of the tobacco sheet is wrapped with a metal foil having higher thermal conductivity than paper. In particular, it is preferable to use a metal foil which has a thermal conductivity of 10 W/m·K or more, is inexpensive, has anti-rusting ability and has high processability (i.e., has high tensile strength and is easily bent with a thickness between several μm and 10 μm) as typified by an aluminum foil and stainless steel foil. The heat conductivities of typical metal foils (alloy foils) are shown in Table 2. Though the case of using an aluminum foil as the wrapping material is described in the above examples, the metal foils shown in Table 2 may optionally be used.

TABLE 2

| Material | Thermal conductivity (W/m · K) |
|---|---|
| Titanium foil | 21.9 |
| Stainless steel foil | 16.3 |
| Nickel foil | 90.7 |
| 42 alloy foil | 14.6 |
| Copper foil | 390 |
| Beryllium foil | 120 |
| Molybdenum foil | 138 |
| Brass foil | 84 |
| Niobium foil | 53.7 |
| Tantalum foil | 57.5 |
| Zinc foil | 11.6 |
| Aluminum foil | 236 |
| Tin foil | 66.6 |
| Silver foil | 420 |
| Kovar foil | 13.7-19.7 |
| Iron foil | 84 |
| Zirconium foil | 22.7 |
| Lead foil | 34 |
| Indium foil | 81.6 |
| Gold foil | 320 |
| Platinum foil | 70 |
| Paper | 0.06 |
| Cigarette paper | 0.3-0.4 |

What is claimed is:

1. A non-combustion flavor inhalation article comprising:

a heating device comprising a heater to be heated to a temperature of between 80 and 140° C., wherein the heater has a hollow cylindrical structure; and a roll disposed to be in contact with the heater, wherein the roll has a hollow cylindrical structure and includes a tobacco sheet and a metal foil wrapping on the outside of the tobacco sheet, and wherein the roll is disposed within the cylindrical structure of the heater such that the metal foil is in contact with an inside surface of the heater.

2. The non-combustion flavor inhalation article according to claim 1, wherein the roll is a shaped, composite structure obtained by laminating the tobacco sheet and the metal foil material in advance.

3. The non-combustion flavor inhalation article according to claim 1, wherein the metal foil is of the same material as that of the inside surface of the heater.

4. The non-combustion flavor inhalation article according to claim 1, further comprising a support disposed inside of the roll, the support being provided with a plurality of projections to support an inside surface of the tobacco sheet with channels formed between the projections and with the inside surface of the tobacco sheet exposed to the channels.

5. The non-combustion flavor inhalation article according to claim 1, further comprising a support disposed inside of the roll, the support having a hollow cylindrical structure and having an opening in a part thereof formed to allow the inside surface of the tobacco sheet to be exposed.

6. The non-combustion flavor inhalation article according to claim 1, wherein at least one of the roll and the heating device contains a flavor or a flavor carrier.

7. The non-combustion flavor inhalation article according to claim 1, wherein the heating temperature of the heater ranges between 100 and 130° C.

8. The non-combustion flavor inhalation article of claim 1, wherein the metal foil is aluminum foil.

9. A non-combustion flavor inhalation article comprising:

a heater having a hollow, cylindrical structure, said heater being adapted to be heated to a temperature between 80 and 140° C., a tobacco sheet in the form of a hollow cylindrical roll disposed within the heater and extending from an end of the heater to form a mouth piece therefor, and a heat-conductor metal foil wrapping disposed on the outside surface of the tobacco sheet and in contact with the inside surface of the heater.

* * * * *